US005627375A

United States Patent [19]

Hsieh

[11] Patent Number: 5,627,375

[45] Date of Patent: May 6, 1997

[54] CIRCUIT ARRANGEMENT FOR A SANITARY APPARATUS

[76] Inventor: Chin-Hua Hsieh, 4Fl., No. 19, Lane 60, Chunghua Rd., Hsintien City, Taipei Hsien, Taiwan

[21] Appl. No.: 554,299

[22] Filed: Nov. 6, 1995

Related U.S. Application Data

[63] Continuation-in-part of Ser. No. 335,123, Nov. 7, 1994, abandoned.

[51] Int. Cl.[6] ..... E03C 1/05; G01J 5/10

[52] U.S. Cl. ..... 250/338.3; 250/342; 4/304; 4/623

[58] Field of Search ..... 250/338.3, 342, 250/DIG. 1; 4/304, 623

[56] References Cited

U.S. PATENT DOCUMENTS

| | | | |
|---|---|---|---|
| 4,941,219 | 7/1990 | Van Marcke | 4/623 |
| 5,086,526 | 2/1992 | Van Marcke | 4/623 |
| 5,217,035 | 6/1993 | Van Marcke | 4/623 X |
| 5,251,872 | 10/1993 | Kodaira | 4/304 X |
| 5,315,434 | 5/1994 | Mizuno et al. | 250/338.3 X |

*Primary Examiner*—Edward J. Glick

*Attorney, Agent, or Firm*—Peterson, Wicks, Nemer & Kamrath, P.A.

[57] ABSTRACT

A circuit arrangement for controlling a sanitary device in a non-contact manner includes a pyroelectric sensing circuit for detecting a temperature in a predetermined location and outputting a signal, a microprocessor for receiving a signal from the pyroelectric sensing circuit and outputting a triggering signal when the signal received by the microprocessor is judged as a result of body heat, a driving circuit for receiving the triggering signal and actuating a motor-operated control valve.

7 Claims, 3 Drawing Sheets

CIRCUIT ARRANGEMENT FOR A SANITARY APPARATUS

CROSS-REFERENCE TO RELATED APPLICATION

The present application is a continuation-in-part (CIP) application of application Ser. No. 08/335,123 to Hsieh entitled "A Circuit Arrangement for a Sanitary Apparatus" that was filed in the U.S. Patent and Trademark Office on Nov. 7, 1994, now abandoned.

FIELD OF THE INVENTION

The present invention relates to a circuit arrangement for a sanitary apparatus, and particularly to an electronic circuit for controlling sanitary fittings in a non-contacting manner.

RELATED PRIOR ARTS

U.S. Pat. No. 5,251,872, entitled *Automatic Cleaner for Male Urinal* discloses a device adapted for automatically cleaning a male urinal. The device includes a pyroelectric sensor for detecting the proximity of the human body, an infrared ray emitting circuit for emitting infrared rays to a human body, and an infrared ray receiving circuit detecting infrared rays reflected by the human body. The device disclosed in U.S. Pat. No. 5,251,872 does not directly take advantage of the pyroelectric sensor to activate the circuits thereof and additionally applies an infrared ray emitting circuit and an infrared ray receiving circuit which obviously increases the cost of the device and additionally consumes a significant power supplied by a battery.

U.S. Pat. No. 4,941,219, entitled *Body Heat Responsive Valve Control Apparatus* relates to a low battery energized passive detection system responsive to radiated body heat for operating fluid flow valves. The disclosed apparatus applies a pyroelectric detector for detecting the presence of body heat within a defined detection field and producing an output signal in response to the detection and a plurality of operational amplifiers for performing the functions of comparing and amplifying. Due to the utilization of valves and operational amplifiers, this apparatus will have a slower response to the variation of the fluid flow and this apparatus is also easily influenced by the variation of the supplied power. Further, as this apparatus uses operational amplifiers, it will consume a lot of power and the battery will not be efficiently used.

SUMMARY OF THE INVENTION

An object of the present invention is to provide a circuit arrangement which prevents automated faucet from wasting water and decreases the risk of electric shock.

Another object of the present invention is to provide a circuit arrangement which allows the automated faucet to be installed conveniently without the interconnection to an alternating current power.

According to the present invention, an electronic circuit includes a pyroelectric sensing circuit for detecting the approach of hands of a user, a microprocessor for analyzing a signal from the pyroelectric sensing circuit and outputting a signal to a driving circuit, a voltage source for supplying the power required by the electronic circuit, an oscillator for providing a signal to the driving circuit and the microprocessor, and a manual operative circuit is connected to the driving circuit for activating the driving circuit.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
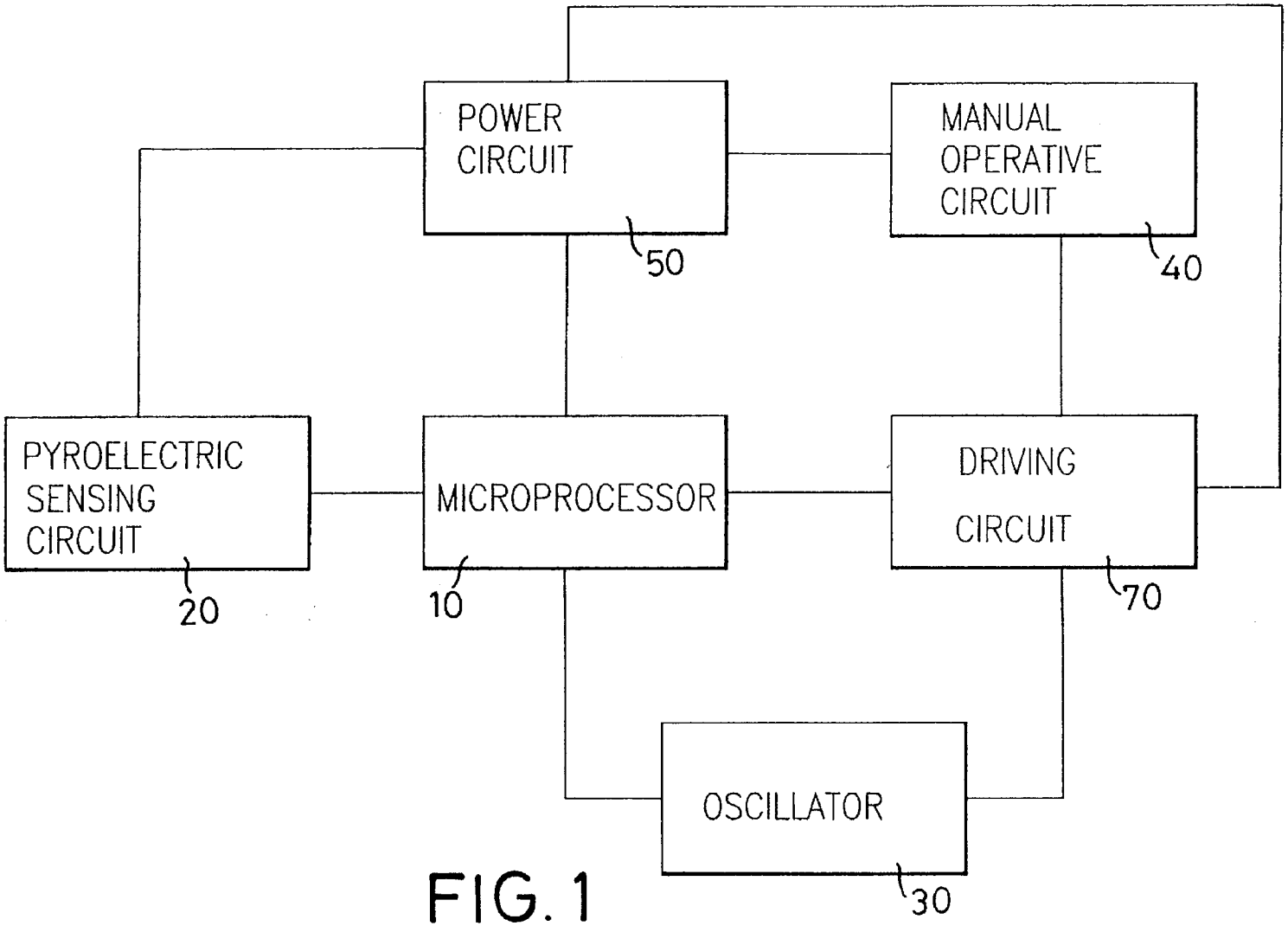
FIG. 1 is a block diagram of the circuit arrangement of the present invention.

Referring to FIG. 1, a pyroelectric sensing circuit 20 detects the presence of body heat within a defined detection field, the pyroelectric sensing circuit 20 then sends a signal to a microprocessor 10, the microprocessor 10 will analyze the signal from the pyroelectric sensing circuit, if the signal received by the microprocessor 10 is judged as a result of body heat, the microprocessor 10 will send a triggering signal to a driving circuit 70 which then outputs a signal to actuate a motor-operated control valve in a faucet. A manual activating circuit 40 is connected to the driving circuit 70 for activation thereof when required. An oscillator 30 is connected to the microprocessor 10 for providing an oscillating signal thereto. The oscillator 30 is further connected the driving circuit 70 for providing an oscillating signal thereto. A power circuit 50 is provided for supplying the power needed by this circuit.

Figure 2:
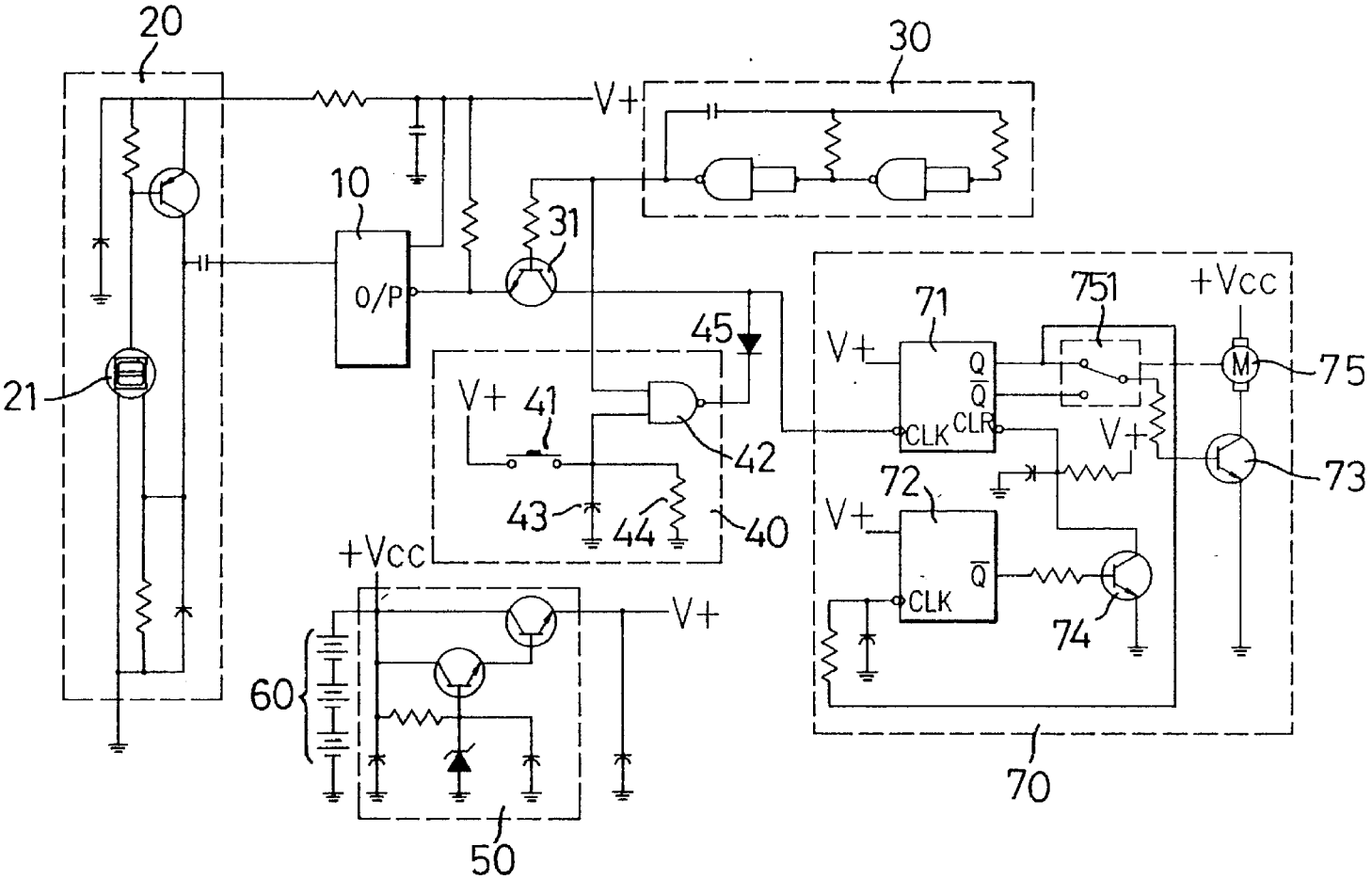
FIG. 2 is a circuit diagram of the present invention.

As shown in FIG. 2, a pyroelectric sensing circuit 20 is composed of a pyroelectric sensor 21 and a plurality of electronic components for detecting the proximity of the human body. An output of the pyroelectric sensing circuit 20 is connected to a microprocessor 10. An output of the microprocessor 10 is connected to an emitter of a transistor 31. An oscillator 30 composed of two NAND gates, a capacitor and two resistors for outputting an oscillating signal is connected to a base of the transistor 31.

A collector of the transistor 31 is connected to a driving circuit 70 composed of two flip-flops 71,72, two transistors 73, 74, a motor-operated control valve 75, and an ON/OFF switch 751. The collector of the transistor 31 is connected to a clock input of the flip-flop 71. A non-inverted output of the flip-flop 71 is connected to a base of the transistor 73 via a normally closed contact of the ON/OFF switch 751. The ON/OFF switch 751 is controlled by the motor-operated control valve 75 and they are connected by a method within the skill of those skilled in the art which causes the ON/OFF switch 751 to activate in a sequence as later mentioned. An inverted output of the flip-flop 71 is connected to a normally open contact of the ON/OFF switch 751.

The motor-operated control valve 75 is connected to a collector of the transistor 73. The non-inverted output of the flip-flop 71 is further connected to a clock input of the flip-flop 72, the inverted output of the flip-flop 72 is connected to a clear terminal of the flip-flop 71 via the transistor 74 for clearing the states of the flip-flop 71.

If the presence of a body heat is detected by the pyroelectric sensing circuit 20, the output of the microprocessor 10 will send a trigger signal of low voltage (e.g. ground potential) to the emitter of the transistor 31. The transistor 31 then outputs a square wave signal having a same frequency as that of the oscillating signal from the oscillator 30 to the clock input of the flip-flop 71 which causes the non-inverted output of the flip-flop 71 to become high, then the transistor 73 is turned on, the motor-operated control valve 75 will start to open. When the valve is at a fully open position, the ON/OFF switch 751 will be actuated, the transistor 73 will be turned off, the motor-operated control valve 75 will be stopped. Thus, the water will continuously flow.

When the hands of the user leave the detection field, the output of the microprocessor 10 will be high, the square wave signal input to the flip-flop 71 is stopped. The inverted output of the flip-flop 71 will become high, then the transistor 73 and the motor-operated control valve 75 are activated and the valve 75 will start to close. If the motor-operated control valve 75 is at fully closed position, the ON/OFF switch 751 is actuated and returns to its initial state. The water flow is stopped.

A manual activating circuit 40 is composed of a NAND gate 42 with two inputs, a capacitor 43, a resistor 44, and a toggling switch 41. A first input of the NAND gate 42 is connected to the base of the transistor 31 and a second input is connected to a positive voltage source V+ via the toggling switch 41. The output of the NAND gate 42 is connected to the clock input of the flip-flop 71 via a diode 45. The capacitor 43 and the resistor 44 are connected between the second input of the NAND gate 42 and the ground for composing a delay function such as ten seconds, that is, the driving circuit 70 will be activated for ten seconds after which the circuit will be disconnected.

As shown in the FIG. 2, a power circuit 50 is composed of a plurality of battery cells 60 connected in series, two transistors in a Darlington connection, a Zener diode, two capacitors, and a resistor for supplying a positive voltage V+ as mentioned above.

Figure 3:
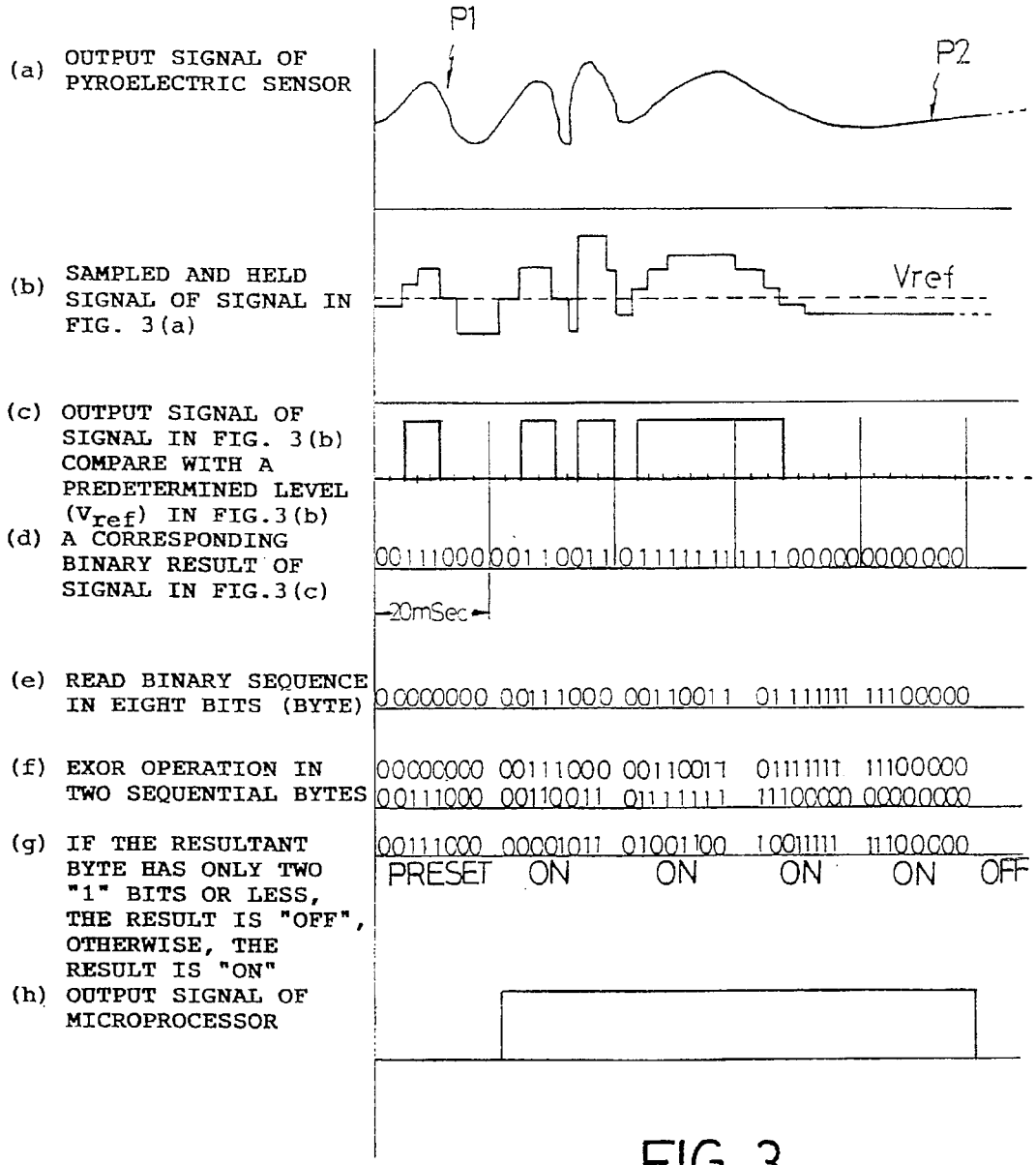
FIG. 3 is a diagram showing operation waveforms of a respective signal in a microprocessor of FIG. 1 and a corresponding digital sequence for the signal.

Referring to FIG. 3A, an output signal of the pyroelectric sensing circuit 20 is shown. This output signal is then transmitted into the microprocessor 10 for further processing. In FIG. 3A, a pulse P1 corresponds to a pulse which has detected a presence of body heat of a user and a pulse P2 corresponds to a pulse which does not detect the presence of the body heat. The signal as shown in FIG. 3A is then sampled and held with a sampling frequency of 400 Hz to derive a resultant signal as shown in FIG. 3B. The sampled and held signal shown in FIG. 3B is then compared with a predetermined reference level Vref (shown in a dashed line), then the waveform having a greater level than the reference level Vref is output, thus, a resultant signal is shown in FIG. 3C which has a corresponding binary sequence as shown in FIG. 3D. The microprocessor 10 then reads the sequence in bytes (eight bits) and executes an exclusive OR operation between two sequential bytes (i.e., a current byte and a preceding byte) to determine whether the pyroelectric sensing circuit 20 detects the presence of the body heat in a detection field. If the resultant byte has three or more "1" bits (includes three "1" bits), the microprocessor 10 will regard as a logic signal of "High" (referred to "H"). If the resultant byte has only two "1" bits or less, the microprocessor 10 will deem the resultant signal as a logic signal of "Low" (Referred to "L"). If the logic "H" signals do not continuously appear, i.e., only appear for 20 milliseconds, the signals received by the pyroelectric sensing circuit 20 will be judged as environmental noises and the motor 75 in FIG. 2 will not be activated. If the logic signal remains "H" for at least 40 milliseconds, the triggering signal will be output to the driving circuit 70 to activate the motor 75.

Although the invention has been explained in relation to its preferred embodiment, it is to be understood that many other possible modifications and variations can be made without departing from the spirit and scope of the invention as hereinafter claimed.

I claim:

1. A circuit arrangement for controlling a sanitary device in a non-contacting manner, comprising:

a pyroelectric detecting means for detecting heat radiating from a human body part within a predetermined location and outputting a signal in response to such detection;

a programmable means for:

receiving the signal from the pyroelectric detecting means;

converting the received signal into a corresponding digital data;

reading the converted digital data in bytes;

logically exclusively ORing two sequential bytes and acquiring a resultant byte; and outputting a triggering signal from an output terminal thereof when two sequential resultant bytes have three "1" bits or more; and a driving means for receiving the triggering signal from the programmable means to activate a valve in the sanitary device.

2. A circuit arrangement according to claim 1 wherein said valve is driven by a motor.

3. A circuit arrangement according to claim 2 wherein said driving means comprises an oscillator for outputting an oscillating signal, a switching device connected between the output terminal of the programmable means and the oscillator, an ON/OFF switch activated by the motor and having a normally closed contact and a normally open contact, a flip-flop connected between the switching device and the ON/OFF switch, a transistor connected between the ON/OFF switch and the motor.

4. A circuit arrangement according to claim 1 wherein said driving means further comprising a manual activating means for activating the driving means.

5. A circuit arrangement according to claim 3 wherein said driving means further comprising a manual activating means for activating the driving means.

6. A circuit arrangement according to claim 5 wherein said manual activating means comprises a NAND gate having a first input connected to the oscillator and a second input connected to a positive voltage via a switch and an output connected to the flip-flop via a diode.

7. A circuit arrangement according to claim 6 wherein said manual activating means further comprises a resistor and a capacitor connected between the second input and a ground potential.

* * * * *